US005419274A

United States Patent [19]

van Diepen

[11] Patent Number: 5,419,274

[45] Date of Patent: May 30, 1995

[54] PLANING BOAT HULL FORM

[76] Inventor: Peter J. van Diepen, P.O. Box 3416, Vancouver, B.C., Canada, V6B 3Y4

[21] Appl. No.: 160,235

[22] Filed: Dec. 2, 1993

[30] Foreign Application Priority Data

Aug. 4, 1993 [CA] Canada ..... 2101912

[51] Int. Cl.[6] ..... B63B 1/00

[52] U.S. Cl. ..... 114/271; 114/288

[58] Field of Search ..... 114/56, 61, 271, 288, 114/290, 291, 289; D12/311-314

[56] References Cited

U.S. PATENT DOCUMENTS

| | | | |
|---|---|---|---|
| 1,189,227 | 7/1916 | Baker | 114/290 |
| 2,369,633 | 2/1945 | Higgins | 114/290 |
| 3,568,617 | 3/1971 | Yost | 114/291 |

FOREIGN PATENT DOCUMENTS

| | | | |
|---|---|---|---|
| 1444117 | 5/1966 | France | 114/288 |

*Primary Examiner*—Edwin L. Swinehart

[57] ABSTRACT

This invention relates to a marine vessel hull form, in particular to a high speed planing boat. It describes a new and distinctive shape of hull which, unlike other hull forms developed to date, features the shape which modifies the flow of water underneath and around it in such a manner that the waves behind the hull at speed are reduced to a minimum. This hydrodynamic effect results in reduced resistance and thus increased speed and/or reduced fuel consumption. Further, it will result in reduced wash behind the boat, an effect that will enable it to operate at full speed near shores where local regulations limit crafts' speed because of shore erosion caused by waves generated by boats and ships. The hull form described in this invention offers more stability than the planing traditional hulls do, due primarily to higher beam to length ratio and to the stern shape, which departs from the traditional "V", which is not particularly stable at speed or stationary.

3 Claims, 2 Drawing Sheets

PLANING BOAT HULL FORM

BACKGROUND OF THE INVENTION

1. Field of the Invention

This invention relates to high speed marine vessel hull form. In particular, it pertains to an improved planing monohull producing hydrodynamic phenomena which reduce resistance and wash.

2. Description of the Prior Art

Planing hulls have been designed and constructed for the past 100 years, ever since the invention of a mechanical form of propulsion of a sufficient ratio of power to weight to propel a marine vessel to a speed, at which the hydrodynamic lift force causes the vessel to raise to the surface and proceed at increased speed.

The higher speed in a planing mode is possible as the resistance is significantly lower than it would be if the hull moved through water at constant draft. Still, a typical planing hull generates a great amount of waves and spray around and behind it at speed. Generation of waves, which represent a deflection, or displacement, of a certain mass of water, requires and absorbs a percentage of energy provided by the propulsive device in form of a single or multiple engines or motors utilizing a stored energy medium (fuel of any kind, accumulated electric power, or other) and driving a reactive device (water or air propeller, water jet, or other). The energy spent on generating waves is wasted, so far as the vessel designer and the operator are concerned, in addition to creating a disturbance for other boat operators and causing shore erosion. The first phenomenon causes an increased fuel consumption and cost of running a boat as well as a reduced potential speed. The latter two are subject to numerous regulations in force, which further limit the boat speed in certain areas.

SUMMARY OF THE INVENTION

The concept behind this invention, which distinguishes it from all other hull forms for similar applications, provides for the shape and form of hull, which reduces the amount of waves generated at speed.

There are two main specific features of the hull form which create the improvement in hydrodynamic performance. First of all, the shape of the stem departs from the traditional shallow or deep "V", which is the main cause of the high stern wave, called the "rooster tail", characteristic for all planing boats at speed. In principle, this wave cannot be avoided, as the pressure of water compressed under the hull causes it (water) to move rapidly upwards immediately behind the vertical transom. However, the author speculated, it can be suppressed and perhaps eliminated, by directing another wave over it. That other wave or "groove" in the water surface can be generated around the transom side edges. The traditional "V" transom shape is quite shallow at the corners, little affecting mass of water in this area. In this invention the comers of transom are pushed quite deep into water, deeper in fact than the inner portion of transom. At speed, the "groove" they create collapses in the direction of lower pressure—towards the centreline of the wake where the "rooster tail" is developing. When set properly (optimum depth of the transom corners being a function of beam and speed), the corner "grooves" collapse onto the "rooster tail", practically eliminating it and resulting in a very flat and smooth wake. Less waves generated by the moving boat take less energy to generate, leaving more energy to propel the vessel to a higher speed.

The second feature contributing to a reduced stern wave are the converging waterlines of the centre portion of the aft hull. Unlike the all existing hulls conforming to the current thinking that a planing hull lines must be parallel in the aft portion thereof, the centre portion of the hull, which directly creates the "rooster tail", narrows towards the stern in this invention thus allowing the pressure of water under the hull (the source of the lifting force) to partially dissipate before reaching the transom where it is released, therefore reducing the size of the "rooster tail" created by pressure release.

These two hydrodynamic effects, when combined by proper sizing and shaping of the transom, can virtually eliminate the stern wave and reduce resistance thus resulting in higher speed.

The improved hydrodynamic performance is achieved primarily by the hull form described above in its aft portion. Forward the hull is of a clean, deep 'V' shape (which breaks into three surfaces and unfolds into a shallow 'M' towards the stern), which offers a superior seakeeping characteristics (smooth ride) in waves at speed. The additional effect of the transom form with deep corners is the increased stability. In a traditional throughout "V" shaped hull, stability is reduced as soon as the bottom emerges from water, which typically happens at quite a shallow angle of heel. In contrast to it, the deep corners of the hull form which is subject of this invention, are submerged for much longer, thus "holding" the vessel upright more effectively.

In addition to the features described above, the reverse chine entrance (the outer chine running lower than the inner chine at the point of contact with water at speed) confines most of the bow wave and spray under the hull before they develop thus reducing side waves and further reducing the resistance.

The form of the hull described above creates a unique and improved concept. A monohull, with all the advantages of simplicity and low cost of construction, high reserve buoyancy (able to carry heavy loads without adverse trim or sinkage) and high stability, which at speed becomes a virtual trimaran in the hydrodynamic sense, fast and stable, but without high degree of complexity and cost of building.

DETAILED DESCRIPTION OF THE DRAWINGS

Figure 1:
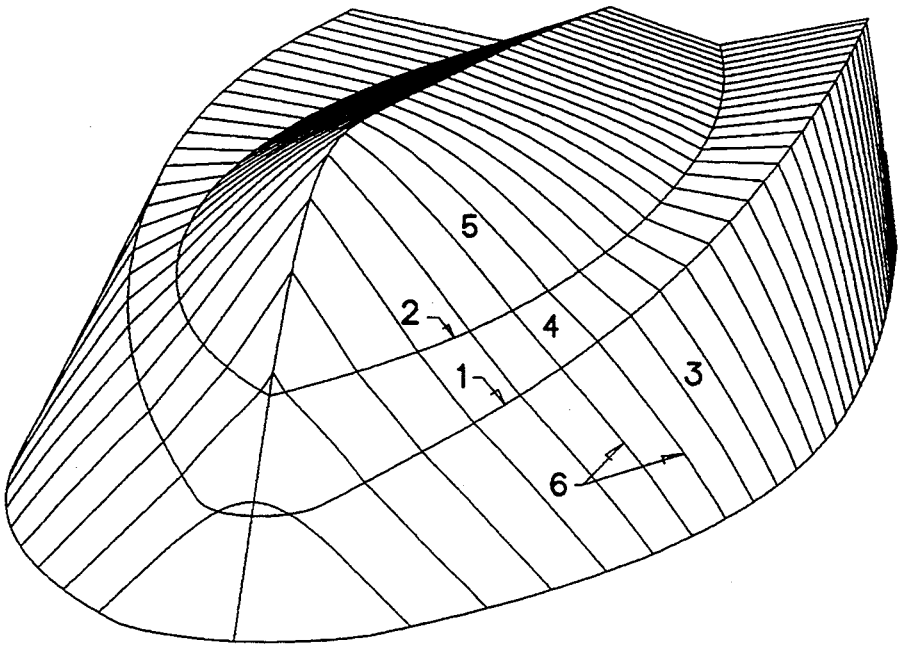
FIG. 1 is a perspective view of the boat hull claimed in this invention, looking from the bow quarter.
Figure 2:
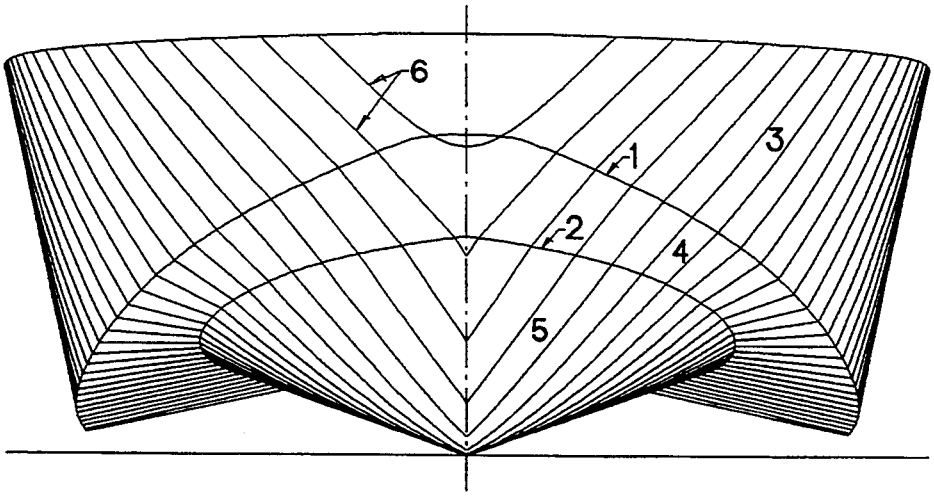
FIG. 2 is a body plan (front view) of the hull.

Referring to the drawings labeled FIG. 1 through 4, the numbers 1 through 7 indicate the following portions of the hull.

1. Indicates the upper chine;
2. Indicates the lower chine;
3. Indicates the upper (side) surface (or panel) of the hull;
4. Indicates the middle surface (or panel) of the hull;
5. Indicates the lower (bottom) surface (or panel) of the hull;
6. Indicates transverse sections through the hull;
7. Indicates horizontal sections (waterlines) through the hull.

FIGS. 1 through 4 illustrate the preferred embodiment of this invention. The specific features which are unique to this invention and their hydrodynamic effect are shown on the drawing and described in detail hereafter, although it should be understood that the invention is not confined to any strict conformity or limited by the accompanying drawings, but it may be modified so long as one or all the essential features are present within the effective limits specified below.

Figure 3:
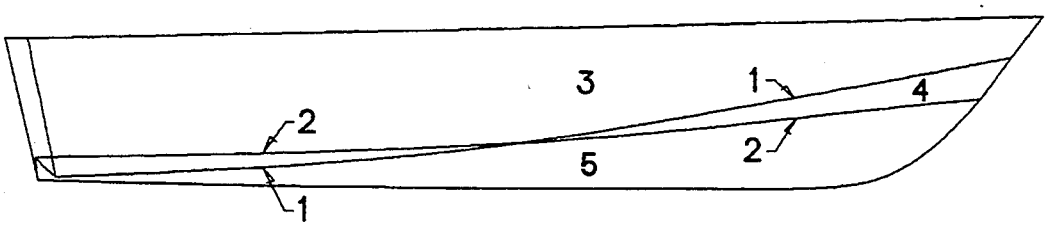
FIG. 3 is a profile (side view) of the hull.
Figure 4:
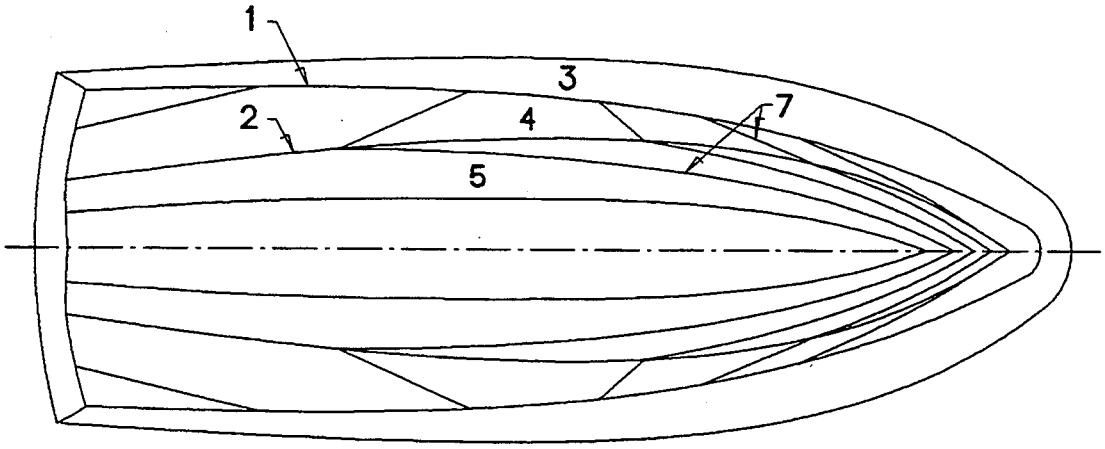
FIG. 4 is a plan (bottom) view of the hull.

The first significant and unique feature, not applied this far to the planing boat design, is crossing of the upper chine (1) and the lower chine (2) in profile (FIG. 3). This results in the middle panel (4) being twisted from a deep "V" forward to an inverted shallow "V" aft. Although twisted, the panel (4) is a developable and buildable surface if a boat is constructed of plywood, aluminum or similar, and it presents no difficulty in forming whatsoever if a boat is constructed in fibreglass or similar. The effect of the twisted panel (4) is a combination of a very deep "V" sections (shown best in FIG. 2) forward, resulting in an excellent seakeeping characteristics in waves at speed, with a highly effective lifting surfaces aft. Said surfaces (4) together with the bottom surfaces (5) form bottom channels in the aft portion of the hull's bottom, in which the air/water spray is confined, reducing the spray and wave outside the hull (thus reducing resistance and increasing speed) and, at the same time reducing friction resistance below the hull. In addition to this hydrodynamic effect, the layout of the chines (1) and (2) forward results in a particularly clean, unbroken by chines (which effectively "disappear" in the bow area) look of the bow. This represents an improvement in the art of planing hull design.

The second significant and unique feature, not applied this far to the planing boat design, is a shallow "M" shape of the transom, resulting from combining a shallow "V" of the bottom panels (5) with a shallow inverted "V" of the middle panels (4) aft. This far, the only accepted transom shape has been a collection of "V" shapes of varying depth, occasionally combined with narrow horizontal middle panels terminating at transom, but meant primarily to add an extra lifting force forward. The "M" transom is the feature, which represents a major departure from a traditional design and causes the most significant hydrodynamic phenomenon of this invention. The outboard corners of the transom are located quite low, in fact they can be the lowest points of the transom! The result "grooves" generated in water immediately behind transom comers at speed. The grooves form a dynamically unstable vertical "wall" in the water, which collapses towards the centreline of the wake. If sized properly, they collapse and cover the developing "rooster tail" (transom wave), which in conventional hulls often is of a significant size (higher than hull) and consequently absorbs a significant energy, resulting in an increased resistance. This is greatly reduced or eliminated by the hydrodynamic effect described above, not only reducing resistance, but also reducing the wash (waves) behind the boat, which is often subject to the operating restrictions close to shore. That means that a boat featuring hull described in this specification can legally operate at higher speeds close to shores and, in addition to having a much lesser impact on shore erosion, can offer a competitive advantage if a boat is operated commercially (i.e. a fast ferry). This represents an improvement in the art of planing hull design.

The third significant and unique feature, not applied this far to the planing boat design, is a lower chine (2) converging aft in a plan view. The current thinking calls, in a quite stringent manner, for all hull lines and chines being straight and parallel to the centreline in the aft section. The departure from this philosophy offers an advantageous modification to the water flow in the stern area at speed. By converging the chines (2) the flow is directed towards the centreline of the wake, creating a reduced pressure zone at transom sides, thus enhancing the effect of the water "walls" collapse, described above. In addition to it, the resulting geometry of the hull produces a less deep centreline "V", further reducing the size of the stern wave. This again represents an improvement in the art of planing hull design.

The features described above fall into a range of sizes, proportions and angles of slope. At the moment the selection is mostly intuitive, as there is no available systematic performance data. However, a future testing program is expected to enable the author to define formulas governing sizing of the panels and angles as function of boat's size and speed. At his point in time the principal features are described in a qualitative manner in the claims, as necessary to generate the hydrodynamic effects described in the specification. A more quantifying formulas will only lead to optimization of these effects.

The embodiments of the invention in which an exclusive property or privilege is claimed are defined as follows:

1. A boat hull form in which the bottom portion of the hull is defined by two principle surfaces elongated longitudinally on each side of the centerline such that one of the surfaces is an inner surface which extends between the centerline of the hull and an inner bottom chine and the other surface is an outer surface which extends between the inner bottom chine and an outermost bottom chine, the transverse sections of the inner surface sloping upwardly from the centerline along its entire length at an angle steep at the bow and gradually shallower towards the stern, the transverse sections of the outer surface sloping upwardly from the inner chine at the bow at an angle generally the same as that of the inner surface, then gradually twisting downwardly toward the stern until extending outwardly and downwardly at the transom, the inner and outermost chines arranged such that a lateral projection of the inner chine is below a lateral projection of the outermost chine in the bow area, and the lateral projection of the inner chine is above the lateral projection of the outermost chine in the stern area.

2. A boat hull form as defined in claim 1, wherein the chines are not sharp but-somewhat-rounded.

3. A boat hull form as defined in claim 1, wherein the aft portion of the inner bottom chine slopes towards the centerline of the hull in the direction towards the transom.

* * * * *